US007015398B2

(12) United States Patent
Vexler et al.

(10) Patent No.: US 7,015,398 B2
(45) Date of Patent: Mar. 21, 2006

(54) COMMUNICATIONS CABLE

(76) Inventors: Gavriel Vexler, 4371 Montrose, Montreal (CA); Jacques Cornibert, 170 Berlioz, Montreal (CA)

( * ) Notice: Subject to any disclaimer, the term of this patent is extended or adjusted under 35 U.S.C. 154(b) by 0 days.

(21) Appl. No.: 10/799,166

(22) Filed: Mar. 10, 2004

(65) Prior Publication Data

US 2004/0216914 A1 Nov. 4, 2004

Related U.S. Application Data

(60) Provisional application No. 60/452,947, filed on Mar. 10, 2003, provisional application No. 60/487,958, filed on Jul. 18, 2003.

(51) Int. Cl.
*H01B 7/00* (2006.01)

(52) U.S. Cl. ..... 174/120 R; 174/121 A

(58) Field of Classification Search ..... 174/113 R, 174/27, 120 R, 121 A, 113 C, 110 PM
See application file for complete search history.

(56) References Cited

U.S. PATENT DOCUMENTS 5,162,609 A * 11/1992 Adriaenssens et al. ..... 174/34
5,563,377 A 10/1996 Arpin et al.
5,773,502 A 6/1998 Takekoshi et al.
6,147,309 A * 11/2000 Mottine et al. ..... 174/110 PM
6,414,070 B1 7/2002 Kausch et al.
6,492,453 B1 12/2002 Ebrahimian et al.
6,573,456 B1 * 6/2003 Spruell et al. ..... 174/110 R
6,787,694 B1 * 9/2004 Vexler et al. ..... 174/27
6,803,517 B1 * 10/2004 Caimi ..... 174/36
2003/0070831 A1 4/2003 Hudson
2003/0125439 A1 7/2003 Ebrahimian et al.
2004/0149483 A1 * 8/2004 Glew ..... 174/113 C

* cited by examiner

*Primary Examiner*—Chau N. Nguyen
(74) *Attorney, Agent, or Firm*—Sacco & Associates, PA

(57) ABSTRACT

An insulated wire for use in a communications cable, the wire comprising a conductor, at least one inner insulating layer surrounding the conductor, and an outer layer surrounding the insulating layers. At least one of the inner layers is a nano-composite comprising nano-sized platelets and a flame and smoke retardant additive package dispersed in a polyolefin matrix. The outer layer is substantially resistant to flame spread and smoke evolution, substantially impermeable to moisture and moisture absorption and has a dielectric constant lower than about 2.5 and a dissipation coefficient lower than about 0.001 at frequencies up to about 650 MegaHertz.

79 Claims, 3 Drawing Sheets

COMMUNICATIONS CABLE

CROSS REFERENCES TO RELATED APPLICATIONS

This application claims benefit of U.S. Provisional Patent application Ser. No. 60/452,947 filed on Mar. 10, 2003, and U.S. Provisional Patent application Ser. No. 60/487,958 filed on Jul. 18, 2003, which are herein incorporated by reference.

BACKGROUND

Statement of the Technical Field

The present invention relates to a communications cable. In particular, the present invention relates to a flame and smoke retardant insulation design for conductive wires used in telecommunications cables having at least one conductive wire comprised of an insulated conductor where the insulation is comprised of an outer layer encasing at least one inner fire retardant layer which in turn encases the conductor.

SUMMARY OF THE INVENTION

There is disclosed an insulated wire for use in a communications cable, the wire comprising a conductor, at least one inner insulating layer surrounding the conductor, and an outer layer surrounding the insulating layers. At least one of the inner layers is a nano-composite comprising nano-sized platelets and a flame and smoke retardant additive package dispersed in a polyolefin matrix. The outer layer is substantially resistant to flame spread and smoke evolution, substantially impermeable to moisture and moisture absorption and has a dielectric constant lower than about 2.5 and a dissipation coefficient lower than about 0.001 at frequencies up to about 650 MegaHertz.

There is also disclosed a communications cable comprising a plurality of insulated wires and an outer jacket. Each of said wires comprises a conductor, at least one fire and smoke retardant inner insulating layer encasing said conductor, and an outer layer encasing said insulating layers. The outer layer is substantially resistant to flame spread and smoke evolution, substantially impermeable to moisture and wherein said outer layer has a dielectric constant lower than about 2.5 and dissipation coefficient lower than about 0.001 at frequencies up to about 650 Mega Hertz.

Additionally, there is disclosed a Category 6 communications cable comprising four twisted pairs of insulated wires and a jacket encasing the wires. Each of the wires comprises a conductor, at least one inner layer encasing the conductor, and an outer layer encasing the inner layers. The cable has a flame travel of less than 5.0 feet, a peak smoke development of less than 0.50 and an average smoke development of less than 0.15 when measured according to NFPA262.

DETAILED DESCRIPTION OF THE ILLUSTRATIVE EMBODIMENTS

Figure 1:
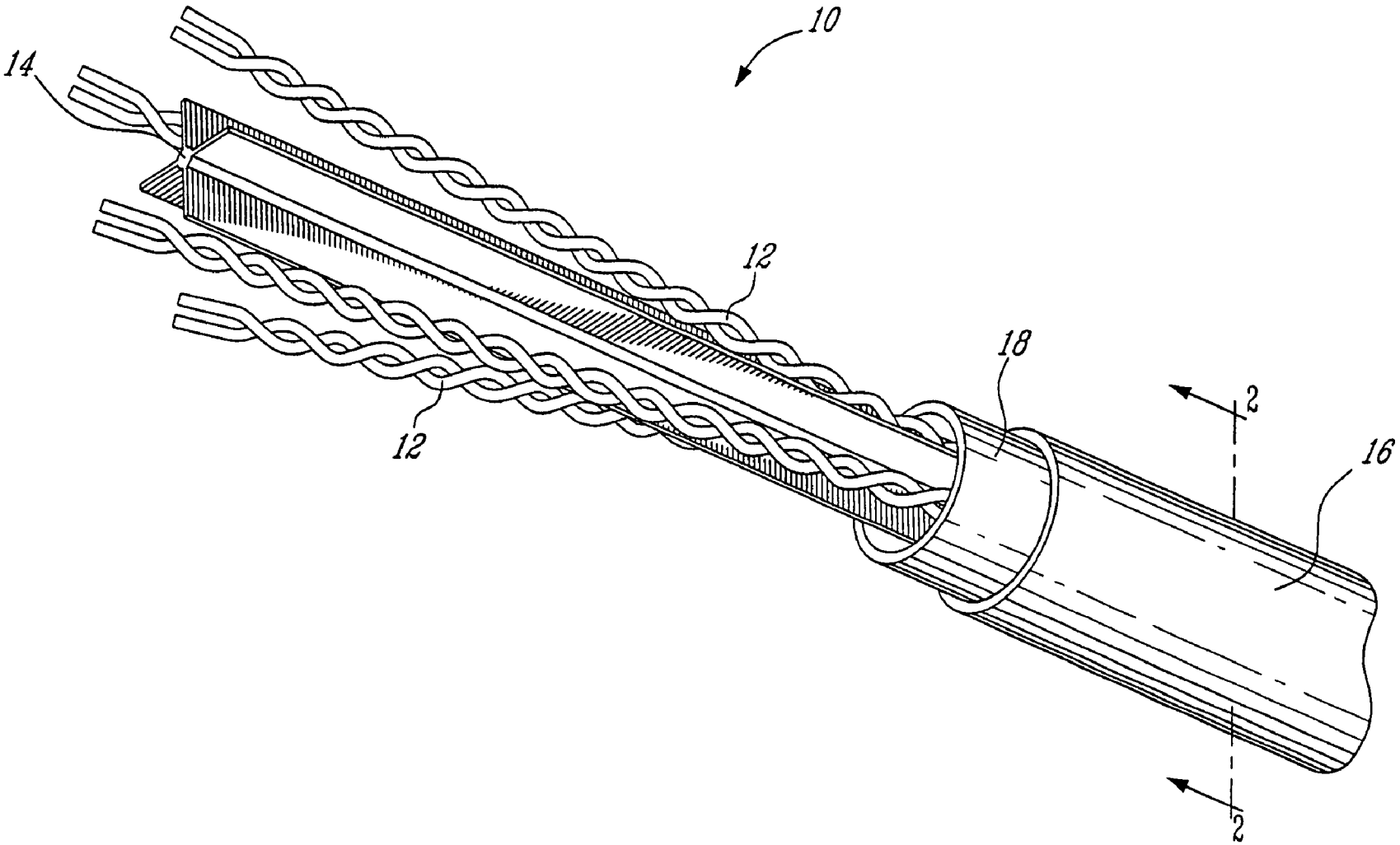
FIG. 1 is a side perspective view of a Category 6 telecommunications cable in accordance with an illustrative embodiment of the present invention.

The fire and smoke retardant compositions of the present invention comprise a polyolefin matrix in intimate admixture with smoke retardant nano-sized particles and a flame retardant additive package. The compositions form a nano-composite having improved flame and smoke retardant properties when compared to a mixture of polyolefin with nano-sized particles or polyolefin with the flame retardant compound alone.

As known in the art, polyolefins are polymer derived by polymerisation of relatively simple olefins. Polyolefins represent a wide range of homo and copolymers, principally containing propylene and ethylene. One important polyolefin which finds wide use in industry is polyethylene. Polyethylene is polymerized ethylene, and is widely used in the manufacture of telecommunication cables due to its excellent dielectric and mechanical properties. Of particular interest are metallocene type polyolefins, elastomer polyolefins, and functionalised polyolefins.

Nano-composites

In order to improve the fire and smoke retardant characteristics of the polymers, nanocomposite fillers are added to the polymer. Nanocomposites consist of nano-meter sized materials which are dispersed at a nano-meter level within a polyolefin matrix. Nanocomposites exhibit many improved properties including gas barrier characteristics and flame retardance. Additionally, nano-materials dispersed in a polymer such as polyolefin can provide good char formation which prevents dripping and improves flame retardancy.

A variety of nano-meter sized materials can be used as a base material for fabricating the nano-composite. The most common are organically modified silicates, or organo-clays, selected from the clay from the smectite family. Smectites are monoclinic clay like materials having a unique morphology, featuring one dimension in the nanometer range. These include such naturally occurring materials as montmorillonite, hectorite and saponite, with montmorillonite currently being the most commonly used. The modified silicates are in the form of broad flat lamellae having a thickness on the order of one (1) nanometer, but have a high aspect ratio with surface dimensions typically in the range of 300 to 600 nanometers, and up to about one (1) micron.

In their initial state, the nano-clay particles are in the form of layered stacks with a small space in between the layers. Unmodified Nano-clays are hydrophilic and have an affinity for moisture while polymers are organophilic and basically immiscible in water. As a result, unmodified nano-clays will disperse only with great difficulty within a polymer matrix.

In order to improve the miscibility of the particles in the polymer matrix, the individual lamellae are typically organically modified using, for example, cationic surfactants which cause the spacing between successive layers to increase while at the same time reducing the particles' surface energy. Modification of the particles' surface chemistry in this manner makes the particles more compatible with the polymers within which they are to be dispersed.

Other synthetic nano-sized compounds are useful as fire retardant fillers in a polymer matrix. For example, nanoparticles derived from synthetic platy silicates having a high aspect ratio are a suitable filler. Additionally, the size and shape of the synthetic varieties of silicates are reproducible, allowing for size and shape to be tailored to a particular application. Furthermore, there is typically less infiltration of impurities into the silicates as would otherwise be found in their natural occurring counterparts.

Depending on the process being used, intimately mixing (or dispersing) the nano-sized particles within a polymer matrix forms either an intercalated or exfoliated nano-composite structure.

Intercalated nano-composites have polymer chains which are intercalated between the layers of the particles resulting in a well ordered multi-layer, where the layers of the clay retain their structural registry. The result is a well ordered multi-layer structure of alternating polymer chains sandwiched between inorganic layers.

Exfoliated (or delaminated) nano-composites are those in which the silicate clay layers or platelets are exfoliated, or separated, for example mechanically by shear mixing, and are randomly and highly dispersed throughout the continuous polymer matrix. The exfoliation process brings the entire surface of the silicate into contact with the polymer, thereby maximising the polymer-clay interaction.

Exfoliation is facilitated by surface compatibilisation chemistry. Surface compatibilisation is the process of surface modifying a nano-clay so that it is attracted to and will disperse in the polymer matrix. The two most common compatibilisation classes are onium ion modification and ion-dipole interaction. Surface compatibilisation expands the nano-clay platelets to the point where individual platelets can be separated from another by mechanical shear or heat of polymerisation. As nano-composites can be created using a variety of polymers, the specific compatibilisation chemistries designed and employed are a function of the selected polymer's chemical and physical characteristics. n some cases, the final nano-composite will be prepared in the reactor during the polymerisation stage. For other polymer systems, processes have been developed to incorporate nano-clays into a hot-melt compounding operation.

Both the intercalated and exfoliated nano-composites exhibit increased thermal stability and improved flame retardancy at reduced loading levels. Additionally, nano-composites give rise to other benefits such as improved mechanical properties in turns of tension, compression bending and fracture. Reduction in loading levels also provides several advantages, particularly in terms of reduced costs, weight and ease of manufacture.

When heated, but prior to ignition, the nano-composite materials form a thin layer of char. As combustion progresses, the nano-composite char remains intact, with successive layers of charred nano-composite resulting in a multi-layer array. The nano-composite structure increases the barrier properties of the char, while at the same time strengthening it, resulting in a structure which acts as a mass transport barrier slowing the supply of oxygen and the escape of volatile gasses given off by the combustion of the polymer. This in turn reduces the amount of polymer available for combustion. Additionally, the use of nano-composite materials leads to a significant reduction in the peak heat release rate and peak smoke release versus polymers treated with conventional fire retardant packages.

A combination of intercalated nano-composites and exfoliated nano-composites is also suitable.

Intumescent Systems

Intumescent materials respond to the presence of a fire by swelling and forming a protective char that physically and thermally protects the structure. Intumescence may be defined as "thermally induced expansion of a material". The mechanism of intumescence may be described as the rapid release of gas or vapour from a matrix which, upon rapid heating, undergoes a plastic or viscoelastic transformation which permits it to be expanded, inflated, or dilated by the expanding vapour or gas.

Generally, it can be said that an intumescent additive system comprises:

- a desiccant (e.g. an inorganic acid or acidic salt);
- a source of carbon (e.g. a carbohydrate);
- a source of nitrogen (e.g. an amine or amide compound); and
- an expanding agent.

Additionally, the intumescents can be surfaced treated (or encapsulated) with hydrophobic polymers in order to limit moisture absorption, to enhance the dispersion of the additives within the polyolefin matrix and to promote adhesion to the polyolefin matrix.

In order for intumescence to occur, the chemical and physical processes which give rise to the formation of an expanded carbonised structure must occur in an appropriate sequence as the temperature of the material rises. For example, it is apparent that the source of carbon cannot decompose or burn before the acid acts as a desiccant. Furthermore, the agents which generate the gases which act as foaming agents need be dispersed throughout the mass in order to form a multi-cellular carbonised structure. Additionally, the above processes occur at predictable temperatures.

As desiccants, typically phosphoric, boric or sulphuric acids are used. In order to be efficient, the acid must be able to desiccate the polymer. However, the polymer must only be desiccated at a certain temperature or in the presence of a flame, which is why acidic salts are in some cases preferred. Additionally, the acid should be liberated under the temperature at which the polyhydric material deteriorates. Typically, salts of amines or amides or organic esters are used.

The sources of carbon are typically selected from the different classes of carbohydrates. Typically, starches and polyhydric alcohol are used. The sources of nitrogen liberate inflammable gasses such as $CO_2$ or $NH_3$ when exposed to high heat. The expanding agents are typically derived from nitrogen. However, in some cases they can be derived from halogens, for example chlorinated paraffin.

Suitable intumescent additives are, for example ammonium or amino compounds, such as ammonium polyphosphate, melamine cyanurate and phosphate derivatives of melamine. In a particular illustrative embodiment the flame and smoke retardant additive package contains at least about 50% intumescent type additives. In an alternative illustrative embodiment the intumescent type additives are dispersed within the polyolefin matrix in combination with other additives, for example molydates, borates, stannates and silicates and combinations thereof.

Halogen and Non-Halogen Additives

A variety of Halogen and Non-Halogen Additives are available. For example, non-halogen additives based on light metal hydroxides (such as magnesium hydroxide and aluminum hydroxide minerals and combinations thereof, for example) are known in the art. In another alternative illustrative embodiment, the non-halogen additive package would contains least about 50% of these light metal hydroxides. The light metal hydroxides can be dispersed within the polyolefin matrix in combination with other additives selected from the group consisting of molydates, borates, stannates, and silicates and combinations thereof. Additionally, the light metal hydroxides can surface treated (or encapsulated) in order to limit moisture absorption, to enhance the dispersion of the additives within the polyolefin matrix and to promote adhesion to the polyolefin matrix. One example of a suitable material for surface treatment is a hydrophobic polymer.

Halogen additives, such as bromine, chlorine, PTFE particles and combinations thereof, can also be added to the polyolefin matrix, illustratively in the form of a flame and smoke retardant additive package containing at least about 50% of these halogen type additives. These halogen type additives can also be combined with antimony oxides in a predetermined molar ratio of about 1 mole of antimony oxides to about 3 moles of halogen. Additionally, the halogen additives can be dispersed in said polyolefin matrix in combination with other minor additives, for example molydates, borates, stannates and silicates and combinations thereof.

Referring to FIG. 1, a Category 6 communications cable, in this case an Unshielded Twisted Pair (UTP) cable and generally referred to by the reference numeral 10, is disclosed. Category 6 cables have evolved from the lower performance Category 5 and Category 5e cabling systems, and consist of four (4) pairs of flame and smoke retardant 22 to 26 AWG gauge insulted cables (or wires) as in 12.

Category 6 specifications command improved characteristics in terms of attenuation and crosstalk (NEXT & FEXT) vis-à-vis the Category 5e specifications. These attenuation and crosstalk characteristics are shown in Table 1.

TABLE 1

| Category | Attenuation (at 100 MHz) | Next (at 100 MHz) |
|---|---|---|
| 5e | 22 dB | 35.3 dB |
| 6 | 19.8 dB | 44.3 dB |

Still referring to FIG. 1, pairs of individual wires 12 are wound helically around one another to form the ubiquitous twisted pairs well known to persons of ordinary skill in the art. Twisted pairs significantly reduce the crosstalk which would otherwise arise as a result of the capacitative interference between two parallel transmission lines. Furthermore, as is also well known in the art, performance of a cable comprised of multiple twisted pairs of wires can be increased by varying the lay lengths of the twists between adjacent pairs (lay lengths typically range from 0.25 to about 1.0 inches for telecommunications cables).

The Category 6 cable 10 may also include an isolating separator 14 between each of the four (4) pairs of wires 12. The communications cable 10 also includes a cable jacket 16, typically manufactured from polyvinylchloride (PVC). In some applications, a shielding material 18 may also be included as part of the cable jacket 16.

Figure 2:
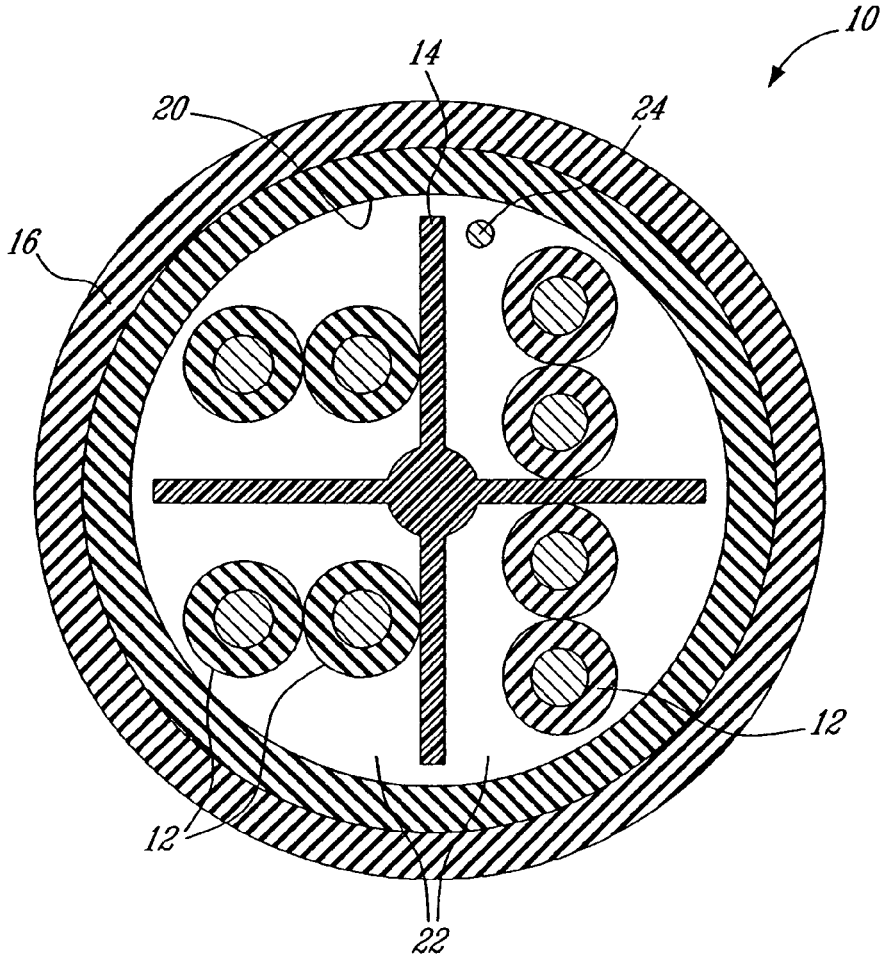
FIG. 2 is a cross section along 2—2 of the Category 6 telecommunications cable in FIG. 1.

Referring to FIG. 2, the isolating separator 14 divides the chamber defined by the inner wall 20 of the cable jacket 16 into a series of four compartments as in 22. Each compartment contains the two wires as in 12 belonging to one twisted pair. The isolating separator 14 is typically manufactured from a pliable water resistant polymer material such as flame and smoke retardant material such as PVC, flame and smoke retardant polyolefin, or FEP. The use of an isolating separator 14 further reduces cross talk thereby improving the performance characteristics of the cable. A ripcord 24 is also included to facilitate the termination of the pairs into the appropriate connector.

Figure 3:
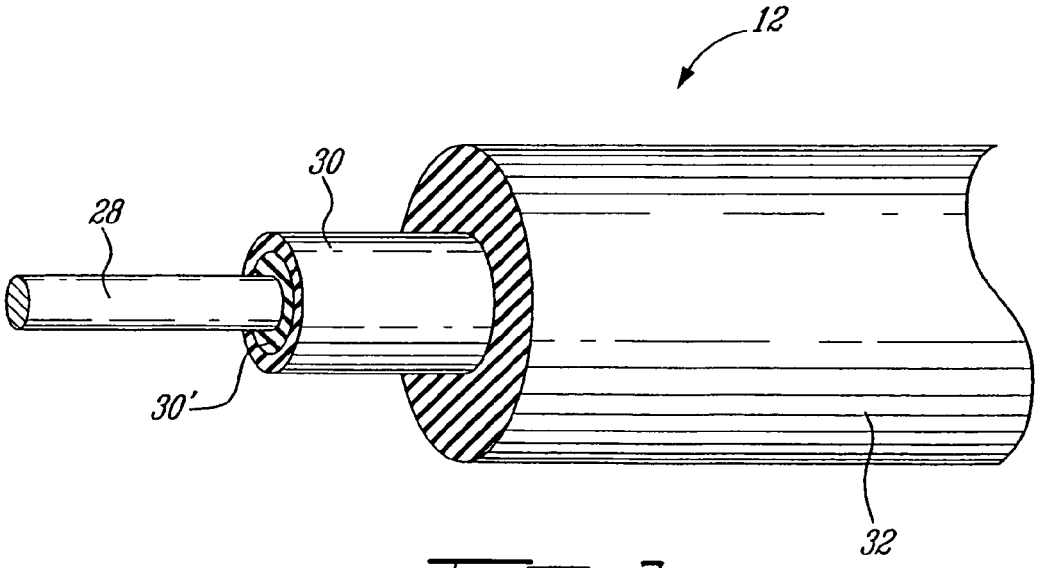
FIG. 3 is a side cutaway perspective view of an insulated wire in accordance with an illustrative embodiment of the present invention.

Referring now to FIG. 3, an insulated wire 12 in accordance with an illustrative embodiment of the present invention is disclosed. The insulated wire 12 is comprised of a conductor 28 manufactured from a conductive metal such as copper. The conductor 28 is encased in an inner layer as in 30 comprised of nano-sized platelets and a flame and smoke retardant additive package dispersed in a polyolefin matrix. The conductor 28 and inner layer(s) 30 are in turn encased in an outer layer 32. In a particular embodiment the overall diameter of the insulated wire 12 that does not exceed about 26 mils. In another particular embodiment, the inner layer(s) and the outer layer combined do not exceed about 12 mils thickness.

In an alternative illustrative embodiment, the insulated wire 12 has two inner layers 30, 30'. The first inner layer 30' surrounds the conductor while the second inner layer, co-extruded with the first, comprises the flame and smoke retardant inner layer 30 as described hereinabove. The outer layer 32 may be applied by tubular extrusion or further co-extrusion to form the complete the insulated wire 12.

The inner layers 30, 30' have a volume of at least about 35% and up to about 70% of the volume of said inner layers 30, 30' and outer layer 32 combined. In a particular embodiment the polyolefin matrix of one or more of the inner layers 30, 30' can be foamed.

The outer layer 32 is fabricated from a material substantially resistant to flame spread and smoke evolution, substantially impermeable to moisture and which has a dielectric constant lower than about 2.5 and dissipation coefficient lower than about 0.001 at frequencies up to about 650 MHz. The outer later 32 should be capable of maintaining these characteristics when immersed in water or subject to 85% humidity at 60° C. for seven (7) days. In an illustrative embodiment the outer layer 16 is fabricated from a fluoropolymer such as Fluorinated Ethylene Propylene (FEP). Typically, the outer layer is colour coded.

Figure 4:
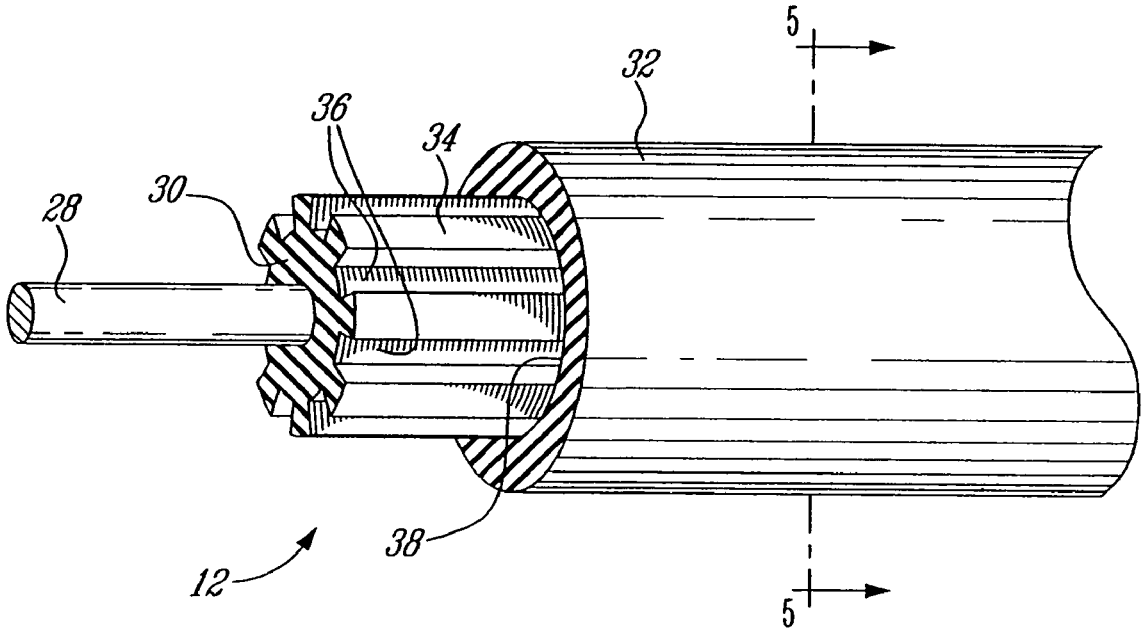
FIG. 4 is a side cutaway perspective view of an insulated wire in accordance with an alternative illustrative embodiment of the present invention.
Figure 5:
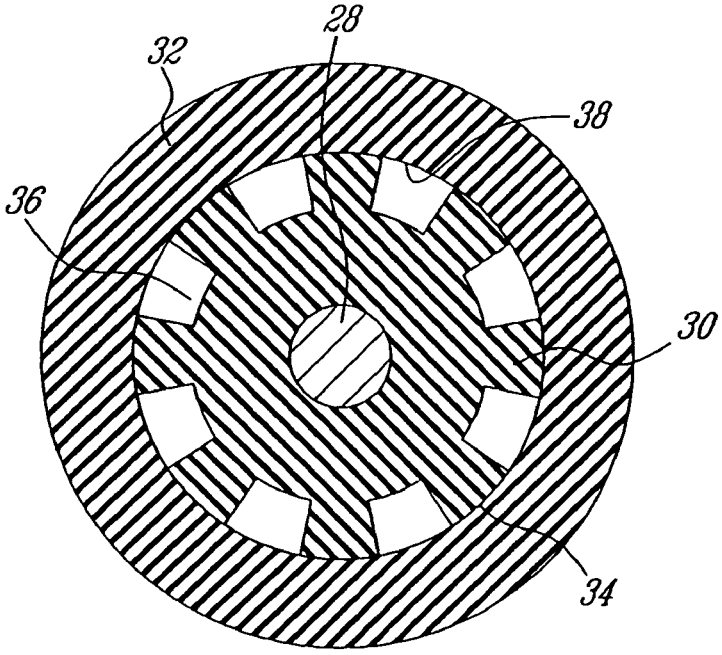
FIG. 5 is a cross sectional view along 5—5 of the wire of FIG. 4.

Referring now to FIG. 4 and FIG. 5, in a second alternative illustrative embodiment the outer surface 34 of the inner layer 30 is striated with a series of spaced channels 36 running longitudinally along the length thereof. The channels 36 are typically equally spaced, of similar cross section and are oriented radially vis-à-vis the axis of the conductor 28 such that they penetrate into the inner layer towards the centre of the conductor 28. In a particular embodiment the depth of the channels is limited to a maximum of about 66% of the total width of the inner layer 30 to maintain structural integrity. The inner surface 38 of the outer layer penetrates into the channels 36, but the penetration is typically limited to about 10% of the overall thickness of the outer layer. The channels provide a number of advantages, including reducing the over all weight of the flammable, providing air gaps which have superior dielectric qualities and improving cooling efficiency during production which simplifies the fabrication of the wire 12.

A series of cables with dual insulation wires were fabricated according to the above techniques and tested according to NFPA 262. Each cable comprised four twisted pairs of wires, each of the wires fabricated using the layer compositions as detailed hereinbelow. The twisted pairs were in turn surrounded by a low smoke PVC jacket.

requirements for attenuation and NEXT. Both layers had identical dimensions as in the $1^{st}$ construction.

Surprisingly, the second construction has handily met the NFPA 262 requirements, as shown bellow, despite the presence of brominated compounds known to generate high levels of smoke during combustion:

Furthermore, in a $3^{rd}$ construction, a chlorinated smoke and flame retardant additive package (Cl) was dispersed in the inner layer. The width (volume) of the inner layer was increased by 40% with a corresponding decrease in the width (volume) of the FEP outer layer.

Surprisingly, the $3^{rd}$ construction has handily met the NFPA 262 requirements, as shown bellow, despite much higher levels of the halogen type additive package. The resulting cable also meets Category 5e requirements for attenuation and NEXT.

In a $4^{th}$ and $5^{th}$ construction, a heavier gauge copper conductor was combined with a larger overall wire diameter, but using the same material composition as in the $3^{rd}$ construction. The volume of the inner layer was decreased to only 25% of the overall volume of the inner layer(s) combined with the outer layers. The resulting cable met both NFPA 262 and Category 6 requirements. However, when the inner layer in the same construction was augmented ($5^{th}$ construction), the resulting cable failed NFPA 262 requirements. The results, as tabled hereinbelow, are results of cables that have one type of jacket material for the $1^{st}$ and $2^{nd}$ constructions and another type for the $3^{rd}$, $4^{th}$ and $5^{th}$ constructions (the PVC used to fabricate the jackets for the $3^{rd}$, $4^{th}$ and $5^{th}$ constructions is of a higher grade, i.e. more highly flame retardant and smoke resistant).

TABLE 2

| | Layer Composition | Copper O.D.(in.) | POFR O.D.(in.) | FEP O.D.(in.) | Vol. % $1^{ST}$ layer | Flame Dist. (ft.) | Peak Smoke | Average Smoke |
|---|---|---|---|---|---|---|---|---|
| 1 | (PO + PTFE)* + FEP** | 0.0207 | 0.027 | 0.036 | 27 | 4.0 | 0.63 | 0.22 |
| 2 | (PO + PTFE + Br)* + FEP** | 0.0207 | 0.027 | 0.036 | 27 | 3.25 | 0.46 | 0.13 |
| 3 | (PO + Cl)* + FEP** | 0.0207 | 0.0275 | 0.036 | 38 | 1.0 | 0.36 | 0.137 |
| 4 | (PO + Cl)* + FEP** | 0.023 | 0.0275 | 0.041 | 25 | 0.92 | 0.37 | 0.135 |
| 5 | (PO + Cl)* + FEP** | 0.023 | 0.0318 | 0.042 | 39 | 2.0 | 0.69 | 0.10 |
| | NFPA 262 Limit | | | | | 5.0 | 0.50 | 0.15 |

*inner layer,
**outer layer

In a $1^{st}$ construction, the inner layer consisted of 40% in weight PTFE particles dispersed in a metallocene type polyolefin (PO) with an FEP outer layer. The resulting cable met Category 5e requirements for attenuation and NEXT.

In a $2^{nd}$ construction, the inner layer consisted of 20% in weight PTFE particles and 20% in weight of a traditional brominated flame and smoke retardant additive package (Br) and FEP outer layer. The resulting cable met Category 5e A $6^{th}$ construction comprised of a brominated type additive package was compared to a $7^{th}$ construction comprising a non-halogen type additive package. As shown in Table 3, both packages would not meet the NFPA 262 Specifications. However, the non-halogen type additive package performed better despite the much higher volume of the inner layer. Both jackets were identical.

TABLE 3

| | Layer Composition | Copper O.D.(in.) | POFR O.D.(in.) | FEP O.D.(in.) | Vol. % $1^{ST}$ layer | Flame Dist.(ft.) | Peak Smoke | Average Smoke |
|---|---|---|---|---|---|---|---|---|
| 6 | (PO + Br)* + FEP** | 0.0201 | 0.026 | 0.034 | 35 | 4.9 | 0.68 | 0.09 |
| 7 | (PO + MgOH)* + FEP** | 0.0201 | 0.0277 | 0.035 | 43 | 5.0 | 0.62 | 0.08 |
| | NFPA 262 Limits | | | | | 5.0 | 0.50 | 0.15 |

*inner layer,
**outer layer

In an $8^{th}$ construction, a non-halogen additive package was augmented with the addition of nano-clays (NC) and the attendant additives to form a nano-composite inner layer which was encased in an FEP outer layer. The jacket was identical to the one used in the $3^{rd}$ to $5^{th}$ constructions. As shown below, the cable with wires comprising a nano-clay composite layer performed much better than those using only the halogen based package ($4^{th}$ and $5^{th}$ constructions). Surprisingly, despite the increase in the inner layer volume vis-à-vis the $4^{th}$ construction (about 60%) and considering that the nano-clay additive constitutes about 2% of the overall package, the performance of the $4^{th}$ construction and the $8^{th}$ construction was similar. On the other hand, the $5^{th}$ construction, which had substantially the same inner layer volume as the $8^{th}$ construction, showed a considerably higher peak smoke (about 53% higher) and failed to meet NFPA 262.

TABLE 4

| | Layer Composition | Copper O.D.(in.) | POFR O.D.(in.) | FEP O.D.(in.) | Vol. % $1^{ST}$ layer | Flame Dist. (ft.) | Peak Smoke | Average Smoke |
|---|---|---|---|---|---|---|---|---|
| 8 | (PO + MgOH + NC)* + FEP** | 0.023 | 0.032 | 0.042 | 40 | 2.5 | 0.40 | 0.11 |
| | NFPA 262 Limit | | | | | 5.0 | 0.50 | 0.15 |

*inner layer,
**outer layer

These results demonstrate the effectiveness of nano-clays and/or synthetic analogs to improve, especially in regard to the smoke retardant performance of the inner layers in a multi-layer insulation construction with a fluoropolymer outer layer. Although only a single construction has been shown, all the flame and smoke retardant packages described hereinabove may be augmented by the addition of nano-clays (NC).

Although the present invention has been described hereinabove by way of an illustrative embodiment thereof, this embodiment can be modified at will without departing from the spirit and nature of the subject invention.

What is claimed is:

1. An insulated wire for use in a communications cable, the wire comprising:

a conductor;

at least one inner insulating layer surrounding said conductor, at least one of said at least one inner insulating layer being a nano-composite comprising nano-sized platelets and a flame and smoke retardant additive package dispersed within a polyolefin matrix; and an outer layer surrounding said at least one inner insulating layer, wherein said outer layer is substantially resistant to flame spread and smoke evolution, substantially impermeable to moisture and moisture absorption and has a dielectric constant lower than about 2.5 and a dissipation coefficient lower than about 0.001 at frequencies up to about 650 MHz;

wherein said at least one inner insulating layer has a volume of at least about 35% and up to about 70% of the volume of said at least one inner insulating layer and said outer layer combined.

2. The insulated wire of claim 1, wherein said outer layer is a fluoropolymer.

3. The insulated wire of claim 2, wherein said fluoropolymer is Fluorinated Ethylene Propylene polymer.

4. The insulated wire of claim 1, wherein said flame and smoke retardant additive package is intimately mixed with said polyolefin matrix.

5. The insulated wire of claim 1, wherein said nano-sized platelets are intimately mixed within said polyolefin matrix.

6. The insulated wire of claim 5, wherein said nano-sized platelets form an intercalated nano-composite structure within said polyolefin matrix.

7. The insulated wire of claim 5, wherein said nano-sized platelets form an exfoliated nano-composite structure within said polyolefin matrix.

8. The insulated wire of claim 5, wherein said nano-sized platelets form a both intercalated and exfoliated nano-composite structures within said polyolefin matrix.

9. The insulated wire of claim 1, wherein said nano-sized platelets are selected from the group consisting of organically modified nano-clays and organically modified synthetic platelets or combinations thereof.

10. The insulated wire of claim 1, wherein said nano-sized platelets comprise synthetic platelets, said synthetic platelets dispersed in said polyolefin matrix.

11. The insulated wire of claim 1, wherein flame and smoke retardant additive package is selected from the group consisting of a non-halogen additive package, an intumescent additive package, a halogen additive package and combinations thereof.

12. The insulated wire of claim 1, wherein said flame and smoke retardant additive package contains at least about 50% light metal hydroxides.

13. The insulated wire of claim 12, wherein said light metal hydroxides are selected from the group consisting of magnesium hydroxide and aluminum hydroxide minerals and combinations thereof.

14. The insulated wire of claim 12, wherein said light metal hydroxides are dispersed within said polyolefin matrix in combination with other additives selected from the group consisting of molydates, borates, stannates, and silicates and combinations thereof.

15. The insulated wire of claim 12, wherein said light metal hydroxides are surface treated.

16. The insulated wire of claim 15, wherein said surface treatment is hydrophobic.

17. The insulated wire of claim 1, wherein said flame and smoke retardant additive package contains at least about 50% intumescent additives.

18. The insulated wire of claim 17, wherein said intumescent additives are selected from the group consisting of melamine cyanurate, phosphate derivatives of melamine, ammonium polyphosphate and combinations thereof.

19. The insulated wire of claim 17, wherein said intumescent additives are dispersed within said polyolefin matrix in combination with other additives selected from the group consisting of molydates, borates, stannates and silicates and combinations thereof.

20. The insulated wire of claim 17, wherein said intumescent additives are surface treated.

21. The insulated wire of claim 20, wherein said surface treatment is hydrophobic.

22. The insulated wire of claim 1, wherein said flame and smoke retardant additive package contains at least about 50% halogen type additives.

23. The insulated wire of claim 22, wherein said halogen type additives are selected from a group consisting of bromine, chlorine, PTFE particles and combinations thereof.

24. The insulated wire of claim 22, wherein said halogen type additives are combined with antimony oxides in a predetermined molar ratio of about 1 mole of antimony oxides to about 3 moles of halogen.

25. The insulated wire of claim 22, wherein said halogen type additives are dispersed in said polyolefin matrix in combination with other minor additives selected from the group consisting of molydates, borates, stannates and silicates and combinations thereof.

26. The insulated wire of claim 1, wherein said polyolefin matrix is selected from a group consisting of metallocene type polyolefins, elastomer polyolefins and functionalized polyolefins and combinations thereof.

27. The insulated wire of claim 1, wherein the polyolefin matrix of at least one of said at least one inner insulating layer is foamed.

28. The insulated wire of claim 27, wherein said nano-sized platelets are dispersed within said foamed polyolefin matrix.

29. The insulated wire of claim 1, wherein the said conductor is a copper conductor and wherein an overall diameter of the wire does not exceed about 26 mils.

30. The insulated wire of claim 1, wherein said at least one inner layer and said outer layer combined do not exceed about 12 mils thickness.

31. The insulated wire of claim 1, wherein an outer surface of said inner layer adjacent an inner surface of said outer layer has a series of channels formed therein.

32. The insulated wire of claim 31, wherein said channels are equally spaced.

33. The insulated wire of claim 31, wherein said channels have identical cross-sections.

34. The insulated wire of claim 31, wherein said channels are projected toward the centre of said conductor and penetrate into said inner layer by no more than about 66% of the total layer thickness.

35. The insulated wire of claim 31, wherein said inner surface penetrates into said channels by no more than about 10% of an overall thickness of said outer layer.

36. A communications cable comprising:

a plurality of insulated wires, each of said wires comprising:

a conductor;

at least one fire and smoke retardant inner insulating layer encasing said conductor, wherein at least one of said at least one inner insulating layer is a nano-composite layer comprising nano-sized platelets and a flame and smoke retardant additive package dispersed within a polyolefin matrix; and an outer layer encasing said at least one insulating layer, wherein said outer layer is substantially resistant to flame spread and smoke evolution, substantially impermeable to moisture and wherein said outer layer has a dielectric constant lower than about 25 and dissipation coefficient lower than about 0.001 at frequencies up to about 650 MHz; and an outer jacket encasing said plurality of wires;

wherein said at least one inner layer has a volume of at least about 35% and up to about 70% of the volume of said at least one inner layer and said outer layer combined.

37. The communications cable of claim 36, wherein said plurality of conductors are twisted into balanced pairs.

38. The communications cable of claim 37, further comprising an insulating separator between each of said balanced pairs.

39. The communications cable of claim 38, wherein the signal attenuation of the cable at least meets the standards of TIA/EIA 568 B.2 & B2.1. and NFPA 262.

40. The communications cable of claim 36, wherein said jacket is flame resistant and has low smoke evolution.

41. The communications cable of claim 36, wherein the cable has flame resistant and smoke evolution properties conforming to NFPA262.

42. The communications cable of claim 36, wherein there are eight wires twisted into four balanced pairs.

43. The communications cable of claim 36, wherein the signal attenuation of the cable at least meets the standards of TIA/EIA 568 B.2 & B2.1.

44. The communications cable of claim 36, further comprising a shielding layer between said jacket and said balanced pairs.

45. The communications cable of claim 44, wherein the signal attenuation of the cable at least meets the standards of TIA/EIA 568 B.2 & B2.1. and NFPA 262.

46. The communications cable of claim 36, wherein said outer layer is a fluoropolymer.

47. The communications cable of claim 46, wherein said fluoropolymer is Fluorinated Ethylene Propylene polymer.

48. The communications cable of claim 36, wherein said flame and smoke retardant additive package is intimately mixed with said polyolefin matrix.

49. The communications cable of claim 36, wherein said nano-sized platelets are intimately mixed within said polyolefin matrix.

50. The communications cable of claim 49, wherein said nano-sized platelets form an intercalated nano-composite structure within said polyolefin matrix.

51. The communications cable of claim 49, wherein said nano-sized platelets form an exfoliated nano-composite structure within said polyolefin matrix.

52. The communications cable of claim 49, wherein said nano-sized platelets form a both intercalated and exfoliated nano-composite structures within said polyolefin matrix.

53. The communications cable of claim 36, wherein said nano-sized platelets are selected from the group consisting of organically modified nano-clays and organically modified synthetic platelets or combinations thereof.

54. The communications cable of claim 36, wherein said nano-sized platelets comprise synthetic platelets, said synthetic platelets dispersed in said polyolefin matrix.

55. The communications cable of claim 36, wherein said wherein flame and smoke retardant additive package is selected from the group consisting of a non-halogen additive package, an intumescent additive package, a halogen additive package and combinations thereof.

56. The communications cable of claim 55, wherein said non-halogen additive package contains at least 50% light metal hydroxides.

57. The communications cable of claim 56, wherein said light metal hydroxides are selected from the group consisting of magnesium hydroxide and aluminum hydroxide minerals and combinations thereof.

58. The communications cable of claim 56, wherein said light metal hydroxides are dispersed in said polyolefin matrix in combination with other additives selected from the group consisting of molydates, borates, stannates, and silicates and combinations thereof.

59. The communications cable of claim 56, wherein said light metal hydroxide minerals are surface treated.

60. The communications cable of claim 59, wherein said surface treatment is with hydrophobic polymers.

61. The communications cable of claim 36, wherein said flame and smoke retardant additive package contains at least 50% intumescent type additives.

62. The communications cable of claim 61, wherein said intumescent type additives are selected from the group consisting of melamine cyanurate, phosphate derivatives of melamine, ammonium polyphosphate and combinations thereof.

63. The communications cable of claim 61, wherein said intumescent type additives are dispersed in said polyolefin matrix in combination with other additives selected from the group consisting of molydates, borates, stannates and silicates and combinations thereof.

64. The communications cable of claim 61, wherein said intumescent type additives are surface treated.

65. The communications cable of claim 64, wherein said surface treatment is with hydrophobic polymers.

66. The communications cable of claim 36, wherein said flame and smoke retardant additive package contains halogen type additives in excess of about 50% of the total additive package.

67. The communications cable of claim 66, wherein said halogen type additives are selected from a group consisting of bromine, chlorine, PTFE particles and combinations thereof.

68. The communications cable of claim 66, wherein said halogen type additives are combined with antimony oxides in a predetermined molar ratio of one mole of antimony oxides to 3 moles of halogen.

69. The communications cable of claim 66, wherein said flame retardant additives are dispersed in said polyolefin matrix in combination with other minor additives selected from the group consisting of molydates, borates, stannates and silicates and combinations thereof.

70. The communications cable of claim 36, wherein said polyolefin matrix is selected from a group consisting of metallocene type polyolefins, elastomer polyolefins and functionalized polyolefins and combinations thereof.

71. The communications cable of claim 36, wherein said at least one of said at least one inner insulating layer is foamed.

72. The communications cable of claim 71, wherein said foamed layer comprises nano-sized platelets dispersed into a foamed polyolefin matrix.

73. The communications cable of claim 36, wherein said conductor is a copper conductor and wherein an overall diameter of the wire does not exceed about 26 mils.

74. The communications cable of claim 36, wherein said at least one inner insulating layer and said outer layer combined do not exceed about 12 mils thickness.

75. The communications cable of claim 36, wherein an outer surface of said inner insulating layer adjacent an inner surface of said outer layer has a series of channels formed therein.

76. The communications cable of claim 75, wherein said channels are equally spaced.

77. The communications cable of claim 75, wherein said channels have identical cross-sections.

78. The communications cable of claim 75, wherein the said indentations are projected toward the centre of the said conductor and penetrate into the said inner layer by no more than about 66% of the total layer thickness.

79. The communications cable of claim 75, wherein said inner surface penetrates into the said channels by no more than about 10% of an overall thickness of said outer layer.

* * * * *